United States Patent [19]

Sekula et al.

[11] 4,207,640

[45] Jun. 17, 1980

[54] DEVICE WITH ROTATING BRUSH AND BUILT-IN LIQUID WASHING AGENTS FEEDER

[76] Inventors: Milan Sekula; Nikola Sekula, both of Trnjanske ledine 1, 41000 Zagreb, Yugoslavia

[21] Appl. No.: 913,535

[22] Filed: Jun. 8, 1978

[30] Foreign Application Priority Data

Jun. 10, 1977 [YU] Yugoslavia ..... 1442/77

[51] Int. Cl.[2] ..... A46B 13/06

[52] U.S. Cl. ..... 15/29

[58] Field of Search ..... 15/29

[56] References Cited

U.S. PATENT DOCUMENTS

| | | | |
|---|---|---|---|
| 1,369,567 | 2/1921 | Smith | 15/29 |
| 1,673,094 | 6/1928 | Stack | 15/29 |
| 2,514,934 | 7/1950 | Chiaie | 15/29 X |
| 2,599,911 | 6/1952 | Haines | 15/29 |
| 2,678,457 | 5/1954 | Demo et al. | 15/29 |
| 3,153,799 | 10/1964 | Williams | 15/29 |

FOREIGN PATENT DOCUMENTS

| | | | |
|---|---|---|---|
| 625315 | 8/1927 | France | 15/29 |
| 569396 | 11/1957 | Italy | 15/29 |

*Primary Examiner*—Edward L. Roberts
*Attorney, Agent, or Firm*—Karl F. Ross

[57] ABSTRACT

A rotary-brush device comprising a downwardly open flat housing closed at its bottom by a cover threaded into this housing and defining a chamber in which a disk having edge-fixed vanes is received. The disk is propelled by a water jet trained on the vanes from a nipple formed on the housing and directed to the flat chamber receiving the disk. The disk is connected to a hollow shaft which rides in a recess formed in the top of this housing and in a bore of the cover, a threaded lower end of the hollow shaft carrying a rotary brush. A hollow shaft has an opening communicating with the chamber. The upper wall of the housing is provided with a passage communicating with a compartment above this wall closed by a threaded cap and receiving a liquid detergent which is to be mixed with the water.

1 Claim, 5 Drawing Figures

DEVICE WITH ROTATING BRUSH AND BUILT-IN LIQUID WASHING AGENTS FEEDER

FIELD OF THE INVENTION

The present invention relates to a rotating brush with a built-in metering feeder for shampoo or any other liquid washing agent to be used for washing of metal, glass and other surfaces.

BACKGROUND OF THE INVENTION

There are various devices designed for washing or polishing which have rotating brushes. Such devices are designed to meet various needs which determine the position of rotating brushes which can be driven by various driving sources such as electric power or water.

Since most known washing devices or apparatuses featuring rotating brushes are of a stationary design, i.e. not portable, or are designed as vehicles, there has been a need for a handy, portable device suitable for washing of not only flat but also curved surfaces and, more important still, of not easily accessible spots on machines, installations etc. which must be washed at regular intervals.

SUMMARY OF THE INVENTION

The rotating brush of the invention has a built-in liquid washing-agent (detergent) feeder facilitating the process of washing. The rotating brush is driven by a water jet and tests carried out on a model have proved a high degree of operational efficiency of the device.

SPECIFIC DESCRIPTION

Figure 1:
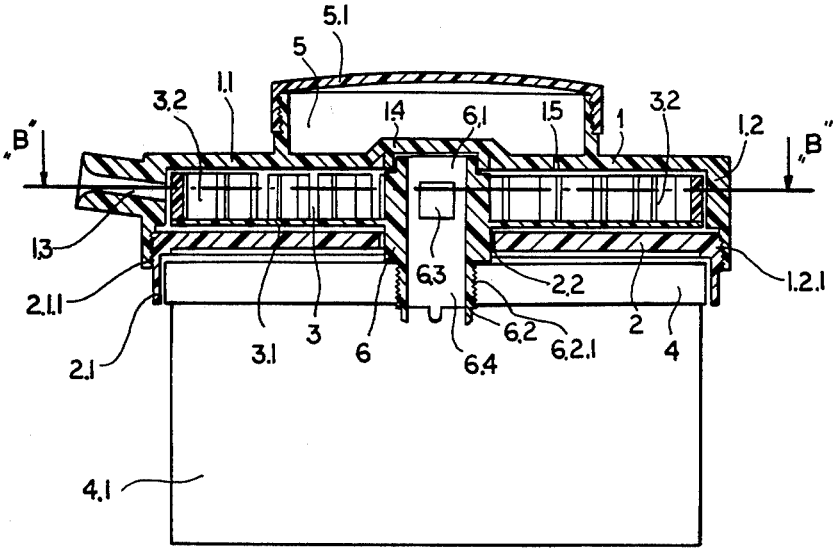
FIG. 1 shows the device in vertical cross-section along line A—A of FIG. 2.
Figure 2:
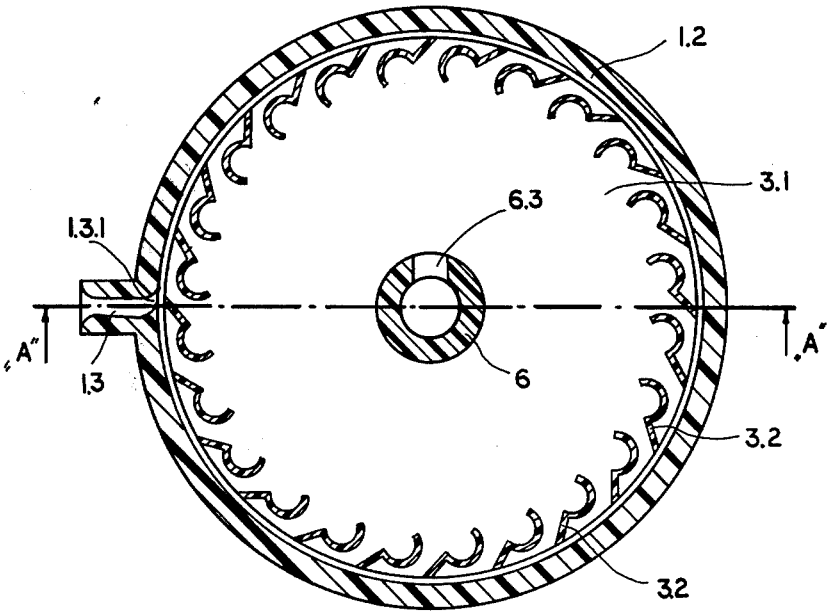
FIG. 2 shows the device from FIG. 1 in horizontal cross-section along line B—B.

As shown in FIGS. 1 and 2, the invention is designed so that its basic components are a housing 1, cover 2, rotary unit 3 and a rotating brush 4.

The housing 1 is of a bell-shaped design having on its upper part a metering feeder chamber 5 with a cover 5.1 threaded onto a central hollow boss of the housing 1. Inside the feeder on the plane 1.1. there is an opening 1.5. designed for the passage for the shampoo or other liquid washing agent. Located at a side 1.2 of the housing 1 there is a nipple 1.3. designed for water feeding into the housing 1 and the rotary unit 3 while on the inside wall of the side section 1.2 there is a threaded connection 1.2.1 i.e. a female thread).

The housing 1 is closed at its bottom part by a downwardly open bell-shaped cover 2 with side wall 2.1. and a central hole 2.2 At the outer side wall 2.1. there is a male threaded connection 2.1.1. to be screwed into the side wall 1.2. of the housing 1.

Inside the housing 1 there is a built-in rotary unit 3 consisting of a plate 3.1. carrying edge-fixed vanes 3.2. and a hollow shaft 6. Juxtaposed with the edge-fixed vanes 3.2. there is the opening 1.3.1. of the nipple 1.3. positioned to use the maximum power of the water fed into the housing 1 in driving the rotary unit 3. The hollow shaft 6 rides at its upper section 6.1 in the centering recess 1.4. in the inner part of the housing 1, and passes at its lower section through the drilled hole 2.2. of the cover 2, while the tapering outlet 6.2. with the threaded connection 6.2.1 is at the outer circumference.

The hollow shaft 6 has inside the housing 1 an opening 6.3; the rotating brush 4 is fixed by the threaded connection 6.2.1. to the outlet 6.2.

Thus designed, the device functions as described below.

After the hose has been connected to a waterline and to the nipple 1.3., water runs through the opening 1.3.1. designed as a nozzle, strikes as a jet against the vanes 3.2. and drives the rotary unit 3 with the hollow shaft 6. Water flows through the housing 1 and enters through the opening 6.3. the hollow shaft 6 and thereafter flows through the opening 6.4. out. Since the hollow shaft 6 at the plane 6.2 carries the rotating brush 4 fixed to it by threaded connection 6.2.1 the brush rotates together with the hollow shaft 6 and water ejects through the opening 6.4. is sprayed over the sides 4.1. of the rotating brush 4, thus starting to wash the surface treated. To facilitate washing, liquid shampoo or some other washing detergent is added into the feeder 5 from which it passes through the opening 1.5. into the housing 1 where it mixed with the water and splashes against the sides 4.1. of the rotating brush 4.

We claim:

1. A washing device comprising:

a flat circular downwardly open internally threaded housing formed with a lateral nipple for connection to a source of water, said nipple opening into said housing at a nozzle adapted to train a jet into the housing;

a downwardly open flat cover threaded into said housing and defining a flat chamber therewith into which said jet is directed, said cover being formed with a central bore;

a rotary unit including a a rotary disk received in said chamber and formed along its edge with a multiplicity of equispaced upstanding vanes each comprising a straight section and an arcuate section inwardly of the straight section said vanes being positiond to be driven by said jet and thereby propel said rotary unit;

a hollow shaft journaled in said housing and said cover and extending through said bore while being connected to said rotary unit so as to be rotated thereby, said housing being provided with an upper wall formed with a central recess receiving said shaft and aligned with said bore;

a brush connected to said shaft below said cover whereby said brush is driven with said shaft by said rotary unit , said shaft having a lateral opening communicating with the interior of said chamber whereby liquid is fed through said shaft to said brush; and means defining a liquid-detergent compartment above said wall for dispensing liquid detergent to said chamber, said means including an annular wall upstanding from said wall of said housing and a cover threaded onto said upstanding wall, said compartment communicating with said chamber by a passage formed in said wall of said housing inwardly of said annular wall and said annular wall lying of the array of vanes.

* * * * *